US009004075B2

(12) United States Patent
Pires et al.

(10) Patent No.: US 9,004,075 B2
(45) Date of Patent: Apr. 14, 2015

(54) WIPER FOR A COSMETIC CONTAINER

(71) Applicant: Zen Design Solutions Limited, Tsim Sha Tsui, Kowloon (HK)

(72) Inventors: Leo Clifford Pires, Basking Ridge, NJ (US); Roger Hwang, Maple (CA); Rahul Bose, New Delhi (IN); Smita Srivastava, New Delhi (IN)

(73) Assignee: Zen Design Solutions Limited, Kowloon, Hong Kong (CN)

( * ) Notice: Subject to any disclaimer, the term of this patent is extended or adjusted under 35 U.S.C. 154(b) by 0 days.

(21) Appl. No.: 14/221,616

(22) Filed: Mar. 21, 2014

(65) Prior Publication Data

US 2014/0290681 A1 Oct. 2, 2014

(30) Foreign Application Priority Data

Apr. 2, 2013 (IN) ..... 995/DEL/2013

(51) Int. Cl.

| | |
|---|---|
| ***A45D 24/00*** | (2006.01) |
| ***A45D 40/26*** | (2006.01) |
| ***A46B 17/08*** | (2006.01) |
| ***A45D 34/04*** | (2006.01) |

(52) U.S. Cl.

CPC ..... *A45D 34/045* (2013.01); *A45D 34/046* (2013.01); *A45D 40/267* (2013.01)

(58) Field of Classification Search

CPC . A45D 34/046; A45D 34/047; A45D 34/045; A45D 40/267; A45D 40/268; A45D 40/26; A46B 2200/1053

USPC ..... 132/200, 218, 317, 318, 320, 313, 73; 401/121, 122, 126, 127, 128, 129, 130; 220/229, 254.2

See application file for complete search history.

(56) References Cited

U.S. PATENT DOCUMENTS

| | | | | |
|---|---|---|---|---|
| 4,332,494 | A * | 6/1982 | Kingsford | 401/5 |
| 4,470,425 | A * | 9/1984 | Gueret | 132/218 |
| 4,609,300 | A * | 9/1986 | Robert | 401/122 |
| 4,617,948 | A | 10/1986 | Gueret | |
| 5,597,254 | A * | 1/1997 | Vasas | 401/122 |
| 5,875,791 | A | 3/1999 | Chang | |
| 5,884,634 | A | 3/1999 | Chang | |
| 6,502,584 | B1 * | 1/2003 | Fordham | 132/218 |
| 6,568,405 | B2 * | 5/2003 | Masuyama | 132/218 |
| 7,186,044 | B2 | 3/2007 | Bailly | |
| 7,452,151 | B2 * | 11/2008 | Rousselet | 401/129 |
| 7,476,044 | B2 | 1/2009 | Gueret | |
| 7,824,121 | B2 * | 11/2010 | Ramet et al. | 401/122 |
| 8,142,093 | B2 * | 3/2012 | Vanoncini | 401/122 |
| 8,221,013 | B2 * | 7/2012 | Salciarini | 401/122 |
| 8,684,615 | B2 * | 4/2014 | Lecoutre | 401/126 |

(Continued)

FOREIGN PATENT DOCUMENTS

| | | |
|---|---|---|
| EP | 0659366 | 6/1995 |

*Primary Examiner* — Vanitha Elgart

(74) *Attorney, Agent, or Firm* — Patterson + Sheridan, LLP

(57) ABSTRACT

The present invention generally relates to a wiper which can be easily inserted into neck of a cosmetic container. The wiper is fabricated from elastomeric material and comprises a plurality of collapsible members configured to collapse horizontally on an exterior surface of the wiper when under stress. The plurality of collapsible members also serves as locking features by which it can be retained in the container neck. The wiper of the present invention can be particularly advantageous for use in the field of cosmetics, especially fluid cosmetic products.

17 Claims, 6 Drawing Sheets

(56) References Cited

U.S. PATENT DOCUMENTS

| | | | | |
|---|---|---|---|---|
| 2003/0196672 | A1* | 10/2003 | Kirita et al. | 132/218 |
| 2009/0065019 | A1* | 3/2009 | Salciarini | 132/218 |
| 2010/0104348 | A1* | 4/2010 | Rauschert et al. | 401/122 |
| 2010/0129132 | A1* | 5/2010 | Pires et al. | 401/122 |
| 2012/0039660 | A1* | 2/2012 | Suzuki et al. | 401/122 |
| 2012/0263515 | A1* | 10/2012 | Pires et al. | 401/122 |
| 2013/0101335 | A1* | 4/2013 | Kulik | 401/122 |
| 2013/0101337 | A1* | 4/2013 | Kulik | 401/122 |

* cited by examiner

WIPER FOR A COSMETIC CONTAINER

CROSS-REFERENCE TO RELATED APPLICATION

This application claims benefit of Indian Provisional Application Ser. No. 995/DEL/2013, filed Apr. 2, 2013, which is incorporated by reference in its entirety.

BACKGROUND

1. Field of the Invention

Embodiments of the present invention generally relate to a wiper for a cosmetic container. The wiper allows for wiping excess product from an applicator upon removal from the container. More particularly, it relates to an elastomeric wiper which can be easily inserted into neck of the cosmetic container, and has novel locking features by which it can be retained in the neck of the container.

The wiper of the present invention can be particularly advantageous for use in the field of cosmetics, especially fluid cosmetic products such as mascaras, foundation, liquid rouge, eyeliners, eye shadow, lip tint, and lip gloss, but can also be used in other fields where wiping of the applicator is desirable.

2. Description of the Related Art

Typical applicator units for cosmetics such as mascara comprise a cosmetic container, a cosmetic contained in the cosmetic container, an applicator comprising a stem and an applicator head capable of being inserted in the cosmetic container in order to take the cosmetic, and a wiper comprising an elongated passage through which the applicator head passes longitudinally on being withdrawn from the container. The wiper is supported by a neck of the container. The wiper serves firstly to wipe the stem and secondly to remove excess cosmetic from the applicator head.

In certain cases such as where cross section of the applicator head varies along its length or the applicator head has small cross section relative to the stem, it is useful to employ a flexible wiper made up of an elastically deformable material.

Customarily, a flexible wiper is mounted in the neck of the cosmetic container to engage the applicator head as the applicator is withdrawn from the container. The wiper is advantageously a unitary body molded of a suitable elastomer, with an outer diameter dimensioned for a snug fit within the container neck, and may be assembled with the container by insertion into the neck. This flexible wiper removes excess product from the applicator head and/or the stem allowing the excess product to fall back or flow back into the container. Generally, this wiper is an open-ended tubular body which includes an elastic annular wiping lip, disposed in the container neck in surrounding relation to the path of the applicator through the neck. Such a wiper is shaped and dimensioned to engage the applicator snugly and conformingly as the applicator is withdrawn through the neck. At its upper end, the wiper includes an outwardly projecting annular sealing flange for overlying a rim of the neck.

Whenever the applicator head passes through a conventional wiper of the type just described, its engagement with the wiping lip exerts a force on the wiper, tending to move the wiper (relative to the container neck) in the direction in which the applicator is moving. If the applicator is being inserted into the container, the positive engagement of the upper sealing flange of the wiper with the rim of the neck prevents the wiper from being dislodged and pushed into the container. During withdrawal of the applicator, however, the sealing flange-rim engagement cannot act to hold the wiper in place, and owing to the inherent deformability of the elastomeric wiper, even interference fit between the wiper and the neck may not prevent the wiper from being pulled out of the container along with the applicator. Such accidental removal of the wiper is messy and inconvenient for the user.

In recent years several modifications have been done to overcome above-mentioned limitation. For Example, U.S. Pat. No. 4,617,948 discloses a wiper made of an elastically deformable material configured to be placed on an internal edge of the container, and held in place by an additional part forming a threaded neck. Such an arrangement, by entailing that the container be made in two parts, increases the number of assembly operations and raises the manufacturing cost of the unit.

In various prior arts, in order to retain the wiper in the container, it has been proposed to provide a solid bulge at the lower end of the wiper, the solid bulge configured to secure the wiper to the container. The bulge is configured to position itself behind the shoulder of the container, thus immobilizing the wiper in a position such that the wiper is secured to the container. Generally, the bulge has sufficient radial width to secure the wiper firmly to the container. For example, U.S. Pat. No. 7,476,044 discloses a wiper which includes an annular shoulder/a bulge arranged at its lower end to snap under the neck of the cosmetic container. The annular shoulder makes it difficult to insert the wiper into neck of the container.

Similar wipers with one or more relatively "solid" bulges are also described in U.S. Pat. No. 5,884,634 and U.S. Pat. No. 5,875,791. Such a system presents a drawback because the bulge renders the insertion of the wiper into the neck of the container difficult due to high resistance generated by the bulge.

U.S. Pat. No. 7,186,044 discloses an outwardly projecting, flexible annular flange or lip adjacent the lower end of the wiper, so as to underlie the interior of the container at the shoulder formed at the lower extremity of the neck. This flexible retaining flange folds or deforms upwardly as the wiper is forced into the neck during assembly and flexes in opposite direction upon emerging into the interior of the container below the neck when the wiper has been fully inserted. Thereafter the retaining flange is supposed to prevent outward movement of the wiper (relative to the neck) by engaging the container around the neck shoulder. The retaining flange is configured to flex axially in two opposing directions and when the wiper is mounted on the container, the flexible flange is elastically stressed which reduces structural strength of the flange.

EP0659366 discloses a tubular elastomeric wiper disposed in the container neck. In assembled condition, there is provided a cylindrical retaining sleeve which surrounds the wiper and has an interference-fit with wiper to retain the wiper in the container neck. The outer diameter of the sleeve is selected to provide a snug fit within the neck. The employment of retaining sleeve around wiper increases the number of components in the assembly and raises the manufacturing cost of the unit.

It would therefore be desirable to provide a wiper for a cosmetic container, of the general type described above, that mitigates or overcomes the aforementioned problems.

SUMMARY

It is a principal object of the invention herein to provide a wiper which is easy to fit into a cosmetic container.

It is an additional object of the invention herein to provide a wiper which is economical to produce.

It is a further object of the invention herein to provide a wiper for a cosmetic container with a good control on the amount of product carried by an applicator.

It is still a further object of the invention herein to provide a wiper configured to be mounted into a neck of a cosmetic container that contains a product to be applied by an applicator comprising a stem and an applicator head.

The present invention provides a wiper which provides substantial cost savings by allowing use of lower cost materials, such as elastomers, and does not require a separate part such as a neck insert to hold the wiper in place.

In accordance with one embodiment of the invention, a wiper, for use in a cosmetic container having a neck, comprises a tubular body; at least two collapsible members protruding from an exposed surface of the tubular body; and wherein each of the at least two collapsible members is capable of flexing in a plane, from a non-collapsed position to a collapsed position and wherein the plane is substantially normal to a longitudinal axis of the wiper. In the collapsed position, the at least two collapsible members are closer to the tubular body than in the non-collapsed position. The term "substantially normal" includes a plane which is absolutely normal to the longitudinal axis of the wiper as well as includes a plane which is at an angle of plus or minus 45 degrees with respect to the plane normal to the longitudinal axis of the wiper.

According to another embodiment of the present invention, the tubular body of the wiper has an interior surface and an exterior surface, which is tightly fittable into the neck of the cosmetic container. The wiper is fabricated from elastomeric material and includes a plurality of collapsible members protruding from the exterior surface of the tubular body. The plurality of collapsible members extends radially outward from the exterior surface of the tubular body. The collapsible members are resilient and are capable of collapsing horizontally on the exterior surface of the tubular body when under stress or at the time when the wiper is inserted into the neck of the cosmetic container. Due to presence of the collapsible members the wiper requires less push force for being inserted into the container than pull force which is required to remove the wiper from the container.

Furthermore, according to an alternate embodiment, the collapsible members may be oriented in a non-radial manner.

According to another embodiment of the present invention, there is provided an elastomeric wiper comprising: a tubular body; a top flange extending outwardly from an upper end of the tubular body; an annular wiping lip extending from an interior surface of the tubular body; a plurality of collapsible members extending radially outward from an exterior surface of the tubular body; wherein the collapsible members comprise fins that are regularly spaced around exterior surface of the tubular body and are inclined counter-clockwise; and wherein the annular wiping lip extends obliquely downwardly from the interior surface of the tubular body towards a longitudinal axis of the wiper and provides a circular opening for the passage of a stem and an applicator head of an applicator.

According to yet another embodiment of the present invention, the wiper comprises a tubular body; a top annular flange extending outwardly from an upper end of the tubular body; a plurality of regularly spaced flexible fins extending radially outward from an exterior surface of the tubular body, the fins are inclined in a counter-clockwise direction; and an annular wiping lip extending obliquely downwards from an interior surface of the tubular body. The tubular body has two opposing ends namely the upper end and a lower end. Further, the tubular body comprises an upper section and a lower section, more preferably the tubular body comprises an upper cylindrical section and a lower cylindrical section, which advantageously may have same inner diameter. More precisely, the plurality of flexible fins extends radially outward from the exterior surface of the lower cylindrical section of the tubular body and each of the plurality of flexible fins is positioned along at least a length of the lower cylindrical section of the tubular body. The annular wiping lip may be located at the interior surface of the tubular body, anywhere between the two opposing ends of the tubular body, more preferably, just above the lower cylindrical section. In alternate embodiments of the present invention, the lower section of the tubular body may have a frustoconical or funnel-like shape, which tapers towards the lower end of the tubular body and wherein the lower end act as a wiping lip. Furthermore, the fins are arranged to collapse horizontally against the exterior surface of the tubular body in response to an external stress.

According to yet another embodiment of the present invention, each of the fins has at least four surfaces. Each of the fins is attached to the exterior surface of the tubular body via at least one surface of the at least four surfaces along the longitudinal axis of the wiper. Optionally, the fins may have a fillet on one of the at least four surfaces in order to strengthen structure of the fin.

According to yet another embodiment of the present invention, at least one of the four surfaces is a joining side surface. Each of the fins is attached to the exterior surface of the tubular body via the joining side surface such that the joining side surface makes an angle of 0 degree to plus or minus 45 degrees with respect to the longitudinal axis of the wiper. According to a preferred embodiment, each of the fins is attached to the exterior surface of the tubular body via the joining side surface such that the joining side surface is parallel to the longitudinal axis of the wiper.

According to yet another embodiment of the present invention, the joining side surface of each of the fins is elongated along the longitudinal axis of the wiper and wherein the fins are attached to the exterior surface of the tubular body via their joining side surfaces such that the joining side surface is parallel to the longitudinal axis of the wiper.

According to yet another embodiment of the present invention, each of the fins has a concave side surface and a convex side surface, and wherein the concave side surface faces the exterior surface of the tubular body and the convex side surface faces away from the exterior surface of the tubular body.

According to an embodiment of the present invention, outer diameter of upper section of the tubular body is more than outer diameter of the lower section of the tubular body. The term "outer diameter of the lower section" as used herein refers to outer diameter of the lower section of the tubular body measured in a plane perpendicular to the longitudinal axis of the wiper without taking into account dimensions of the fins in that plane.

According to an embodiment of the present invention, there may be provided at least two grooves, extending parallel or non-parallel to the longitudinal axis of the wiper, on the lower section of the tubular body such that a major length of each of the groove is hidden by the respective inclined overlying fin. The at least two grooves allow easy bending of the fins so that a portion of the fins can be positioned in the grooves when the fins are bent against the tubular body in response to external stress. In alternate embodiments of the present invention, the at least two grooves may extend parallel to the joining side surface of each of the fins.

According to another embodiment of the present invention, the fins may have a quadrant shape or other differing shapes such as a wedge, ear-like shape or any triangular shape.

In an alternate embodiment of the present invention, wings can be used instead of fins to implement the present invention.

According to an alternate embodiment of the present invention, the plurality of regularly spaced fins extends radially outward from the exterior surface of the tubular body and is inclined in a clockwise direction.

The wiper, when outside the container, is present in a first position, wherein the fins are in a non-collapsed position and an outer dimension of lower section of the tubular body is greater than an outer dimension of the upper section of the tubular body. The term "outer dimension of the lower section" as used herein refers to maximum transverse dimension of the lower section measured in a sectional plane that is perpendicular to the longitudinal axis of the tubular body. Similarly, the term "outer dimension of the upper section" as used herein refers to maximum transverse dimension of the upper section of the tubular body measured in a sectional plane that is perpendicular to the longitudinal axis of the tubular body. During insertion of the wiper into the neck of the container, the wiper takes a second position, wherein the fins are in a collapsed position due to a uniform radial stress which in turn causes the lower section of the tubular body to deform radially inwardly to produce wrinkles or undulations thereon. The plurality of fins on the lower section collapse horizontally against the exterior surface of the tubular body such that a portion of the fins are disposed in respective grooves, as a result of which the outer dimension of lower section of the tubular body becomes equal or less than the outer dimension of the upper section of the tubular body. The deformation of lower section and collapsing of fins make it easy to fit the wiper into the neck of container as it allows decreased resistance to insertion of the wiper into the neck of the container. Once the wiper is fully inserted, it regains the first position in which the lower section along with fins resiliently returns to their original non-collapsed position. In the non-collapsed position, at least one surface of the at least four surfaces of the fins is positioned below an inner shoulder of the container and locks against the inner shoulder of the container offering resistance to extraction of the wiper from the neck of the container, when the wiper is tried to be pulled out of the container.

In another preferred embodiment, the wiper is made of an elastically deformable material. The elastically deformable material may be chosen, for example, from thermoplastic or crosslinked elastomers, for example, EPDMs, natural rubbers and nitrile, butyl or silicone elastomers. In the case of a crosslinked elastomer, the wiper can be manufactured in a compression mould, heated to the appropriate temperature.

According to another embodiment of the invention, there is provided an applicator unit comprising a cosmetic container containing a product; an applicator comprising a closure cap for closing an opening of a neck; a stem fixed at one end to the closure cap such as to extend downwardly there from into the cosmetic container when the cap is placed to cover the opening of the container; an applicator head such as a brush fixed to the other end of the stem, immersed in the product and which can be used to apply the product. The container is fitted with a wiper of the present invention. The applicator head of applicator passes through the wiper when the applicator is withdrawn from the container, so as to reduce the excess amount of product on the applicator head. The container can be obtained by molding a material such as a polypropylene.

According to an embodiment of the present invention, there is provided an annular seat which extends from the interior surface of the tubular body of the wiper, located just above the annular wiping lip, and which aids in easy insertion of the wiper into the container neck. An insertion shaft, commonly employed to insert the elastically deformable wipers such as wipers made from elastomeric material, may come into abutment against the annular seat of the wiper of the present invention, and this particular arrangement prevents the occurrence of back folding of the deformable wiper during insertion into the cosmetic container.

According to an alternate embodiment of the present invention, the annular seat may be discontinuous.

A wiper in accordance with the invention can be used in a variety of applicator units.

The applicator can be, for example, an applicator for the eyelashes or eyebrows, e.g., in the form of a twisted or molded brush, a brush of the paintbrush type, an eyeliner, a block of foam, a frit, a pen or a felt. The product in the container can be a cosmetic product, or another type of product applied to the applicator, with the wiper preventing or reducing the presence of excess amount of the product on the applicator when the applicator is removed from the container. Mascara, lipstick, e.g. a liquid lipstick, lip gloss, foundation, nail varnish, eye shadow, eye liner. etc are a few example of the products that can be stored in the container.

The term "plurality" as used herein, refers to two or more collapsible members or grooves.

The above and other objects, features and advantages of the present invention will become clear from the following description of the preferred embodiments when the same is read in conjunction with the accompanying drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
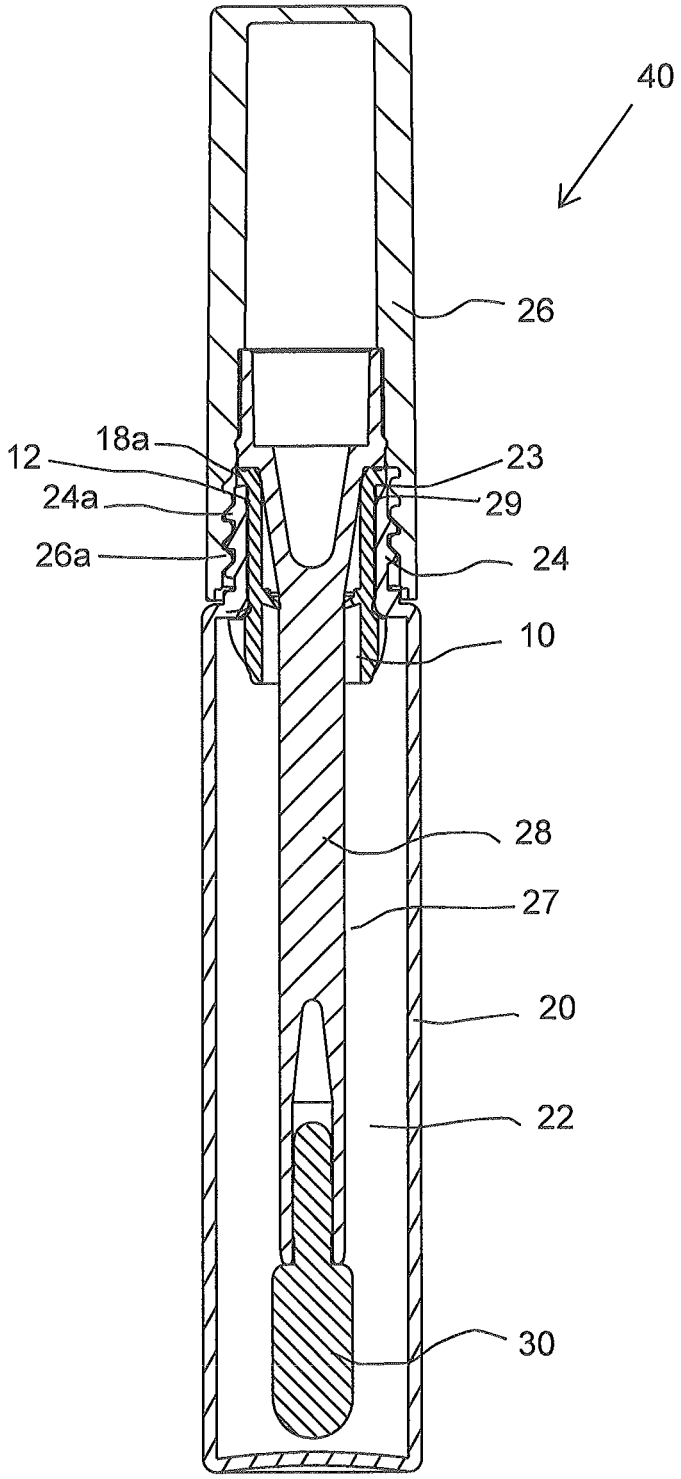
FIG. 1 illustrates a longitudinal cross-sectional view of an applicator unit equipped with a wiper according to an embodiment of the present invention.
Figure 2A:
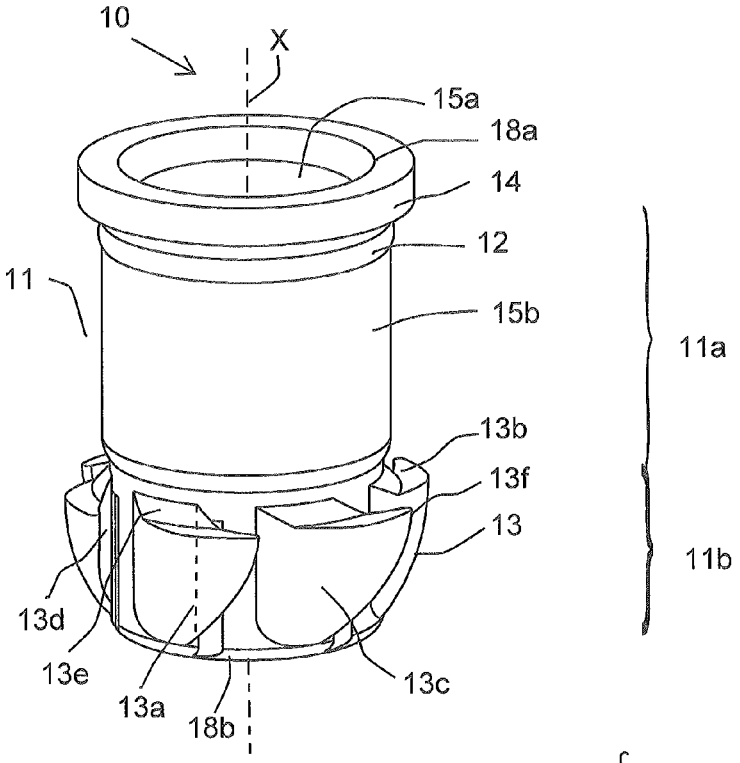
FIG. 2A is a perspective view of a wiper according to an embodiment of the present invention.
Figure 2B:
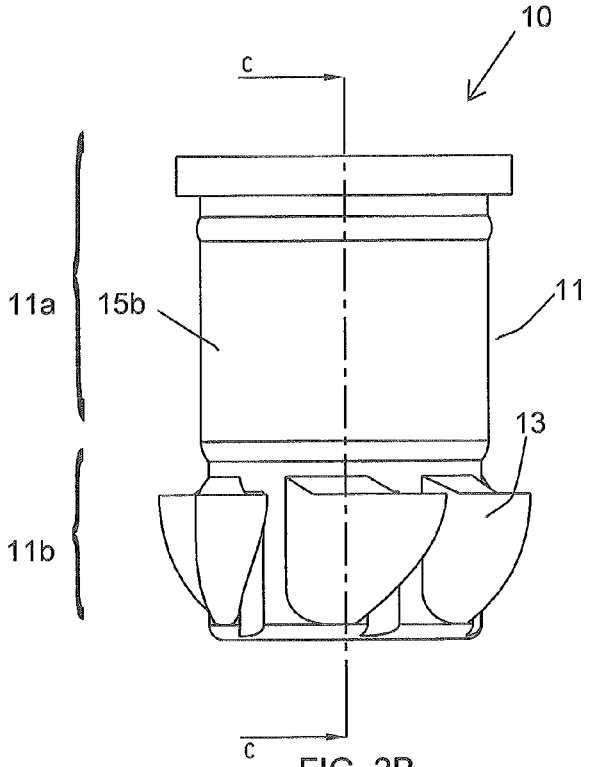
FIG. 2B is a front view of the wiper of FIG. 2A.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

Referring now to FIGS. 1-6B, wiper 10 in accordance with the invention is shown.

As seen particularly in FIG. 1, there is provided an applicator unit 40 comprising a cosmetic container 20 and a wiper 10 according to present invention intended for use in the cosmetic container 20 having a chamber 22 for containing a product (not shown) and a neck 24. The applicator unit 40 further comprises an applicator 27 comprising a closure cap 26, a stem 28 and an applicator head 30. The closure cap 26 is removably secured to the neck 24. The neck 24 has external threads 24*a* and the closure cap 26 has mating internal threads 26*a* in its inner surface so that the closure cap 26 can be screwed onto neck 24. The stem 28 is affixed to and extends downwardly from the closure cap 26. The stem 28 extends downwardly through the neck 24 into the chamber 22. The applicator head 30 is mounted on distal end of the stem 28 for carrying the product from the chamber 22 upon removal of the applicator 27 from the cosmetic container 20. The applicator head 30 may comprise a mascara brush which may comprise a twisted wire brush containing bristles or a molded mascara brush. Alternatively, the applicator head 30 may comprise cosmetic foam, sponge or a felt tip or other absorbent or porous material having a product carrying capacity. The particular applicator head will be selected depending on the specific product provided in the chamber 22.

As seen in FIGS. 1-6B, the wiper 10 is fabricated from an elastically deformable material. The elastically deformable material may be chosen, for example, from thermoplastic or crosslinked elastomers, for example. EPDMs, natural rubbers and nitrile, butyl or silicone elastomers.

Referring to FIG. 1 to FIG. 3A, the wiper 10 includes a tubular body 11 which is cylindrical in shape. Further, the tubular body 11 consists of an upper cylindrical section 11*a* and a lower cylindrical section 11*b*, which advantageously have the same inner diameter d1. However, outer diameter d2 of the lower cylindrical section 11*b* of the tubular body 11 is less than outer diameter d3 of the upper cylindrical section 11*a* of the tubular body 11. There is a retention bead 12 on the upper cylindrical section 118 configured to fit into a complimentary retention groove 29 located on the inner wall of the neck 24 of the cosmetic container 20, when the wiper 10 is fully seated on the cosmetic container 20. The retention bead 12 and the retention groove 29 stabilize the wiper 10 in the neck 24 of the cosmetic container 20 by opposing any movement of the wiper 10, as for example, when the applicator head 30 passes through the wiper 10.

The tubular body 11 has an interior surface 15*a* and an exterior surface 15*b*. The wiper 10 has a top annular flange 14 extending outwardly from an upper end 18*a* of the tubular body 11 for seating on an upper edge 23 of the neck 24.

Further, the tubular body 11 has a plurality of collapsible members such as flexible fins 13 extending radially outward from the exterior surface 15*b* of the tubular body 11. The flexible fins 13 are regularly spaced and are inclined in a counter-clockwise direction around the periphery of the tubular body 11. More particularly, the flexible fins 13 extend radially outward from the lower cylindrical section 11*b* of the tubular body 11. The fins 13 have a quadrant shape; each fin 13 comprises four surfaces namely a first joining side surface 13*a* (the first joining side surface 13*a* is not visible because it is joined with tubular body 11—as represented by the dotted line in FIG. 2A), a second upper surface 13*b*, a third convex side surface 13*c* and a fourth concave side surface 13*d*. The fins 13 are attached to the exterior surface 15*b* of the tubular body 11 via their first joining side surface 13*a* which is elongated along a longitudinal axis X of the wiper 10 such that the joining side surface 13*a* is parallel to the longitudinal axis X of the wiper 10. The fins 13 are attached at least along a length of the lower section 11*b* of the tubular body 11. According to an alternate embodiment of the invention, the joining side surface 13*a* can also make an angle of 0 degree to plus or minus 45 degrees with respect to the longitudinal axis X of the wiper 10. The surfaces 13*b*, 13*c* and 13*d* define a free end 13*f* of the fin 13. Thickness of each of the fins 13 decreases from the first joining side surface 13*a* towards the free end 13*f* of the fin 13. The concave side surfaces 13*d* faces the exterior surface 15*b* of the tubular body 11 and the convex side surfaces 13*c* faces away from the exterior surface 15*b* of the tubular body 11. Each of the fins 13 is capable of flexing in a plane from a non-collapsed position to a collapsed position and wherein the plane is substantially normal to a longitudinal axis X of the wiper 10. The term "substantially normal" includes a plane which is absolutely normal to the longitudinal axis of the wiper as well as includes a plane which is at an angle of plus or minus 45 degrees with respect to the plane normal to the longitudinal axis X of the wiper 10. Each of the fins 13 is configured to move into a collapsed position where each of the fins 13 collapses substantially horizontally or substantially normal relative to the longitudinal axis X of the wiper 10 against the exterior surface 15*b* of the tubular body 11 in response to an external stress, such as stress received during insertion of the wiper 10 into the neck 24 of the cosmetic container 20 and when this stress is relieved each of the fins 13 resiliently return to its original non-collapsed position. In the non-collapsed position, the concave side surface 13*d* of the fins 13 does not abut against the exterior surface 15*b* of the tubular body 11, however, in a collapsed position, the concave side surface 13*d* of the fins 13 abut against the exterior surface 15*b* of the tubular body 11 and conform to shape of the exterior surface 15*b* of the tubular body 11 in response to the stress received during insertion of the wiper 10 into the neck 24 of the cosmetic container 20. The wiper 10 also includes inclined portions or fillets 13*e* on the second upper surfaces 13*b* to provide additional structural strength to the fins 13. It is, however, obvious to a person skilled in the art that the wiper 10 of the present invention may be realized without fillets 13*e*.

Figure 3A:
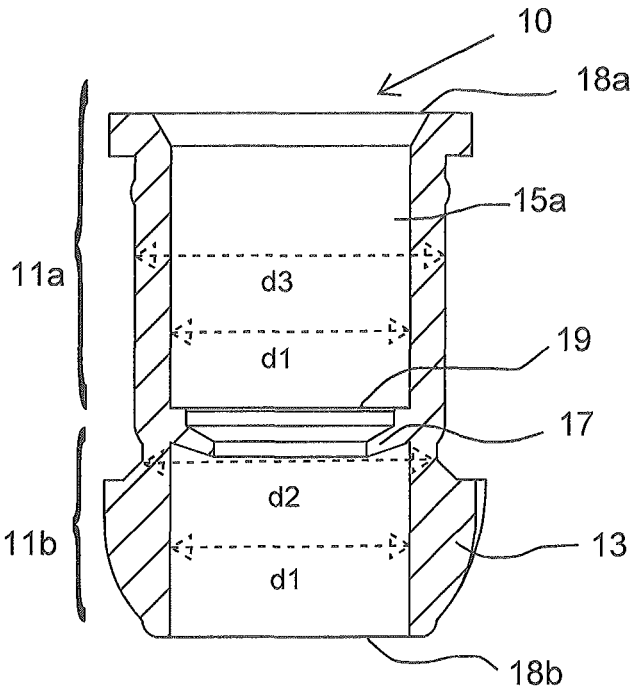
FIG. 3A is a cross sectional view along line C-C of the wiper of FIG. 2B according to an embodiment of the present invention.
Figure 3B:
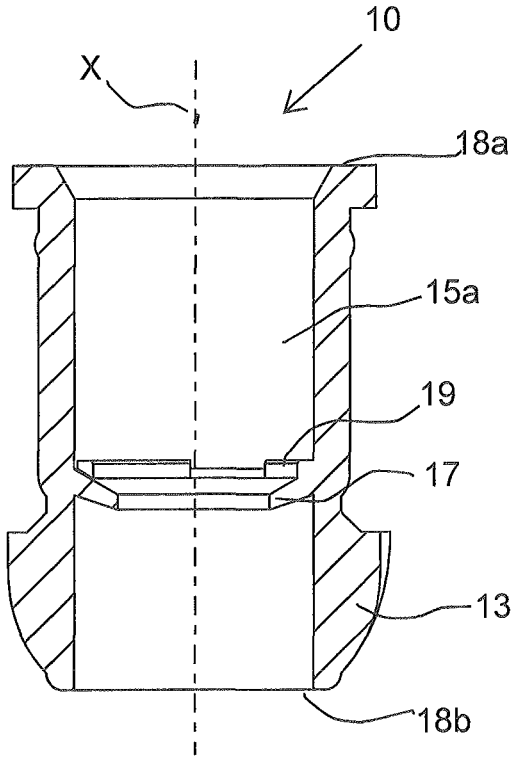
FIG. 3B is a cross sectional view of a wiper according to an alternate embodiment of the present invention.

Referring to FIG. 3A and FIG. 3B, the wiper 10 further comprises an annular wiping lip 17 that extends obliquely downwards from the interior surface 15*a* of the tubular body 11 of the wiper 10. The annular wiping lip 17 may be located anywhere between two opposing ends, the upper end 18*a*, a lower end 18*b* of the tubular body 11, but more preferably just above the lower cylindrical section 11*b*. The annular wiping lip 17 provides a circular opening 17*a* (shown in FIG. 4B) for the passage of the cylindrical stem 28 and the applicator head 30 of the applicator 27.

FIG. 3A shows, the wiper 10 according to an another embodiment of the present invention may include an annular seat 19, extending substantially perpendicularly from the interior surface 15*a* of the upper cylindrical section 11*a* of the tubular body 11, just above the annular wiping lip 17 to aid in easy insertion of the wiper 10 into the neck 24 of the cosmetic container 20. According to an alternate embodiment of the present invention and as shown in FIG. 3B, the seat 19 can be discontinuous.

Figure 4A:
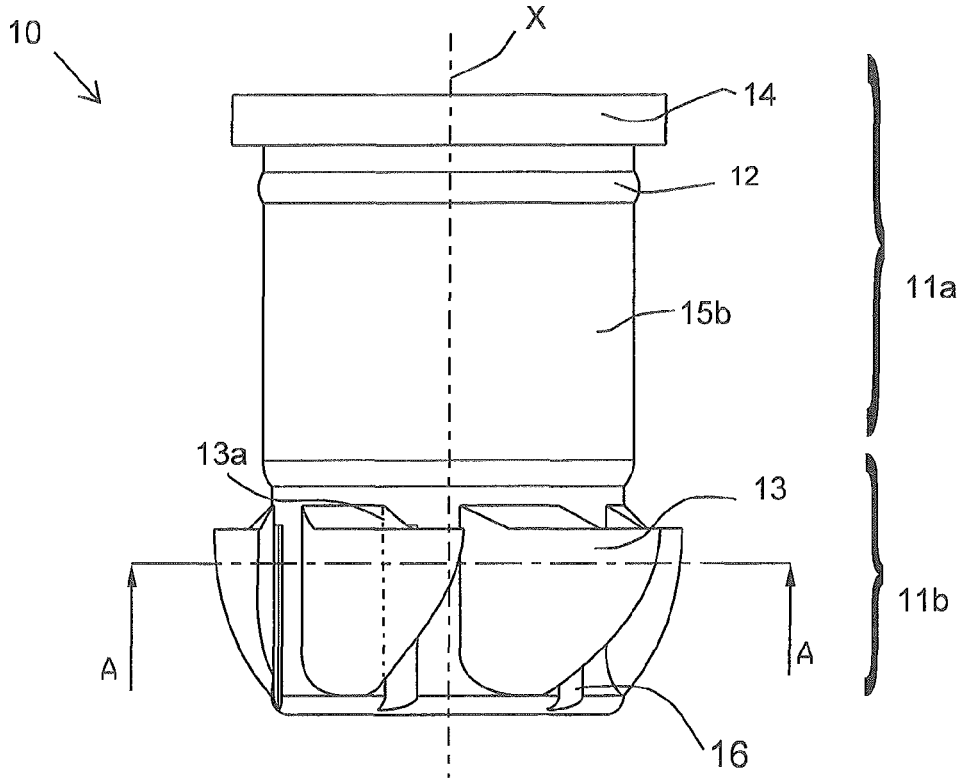
FIG. 4A is a side view of the wiper of FIG. 2A.
Figure 4B:
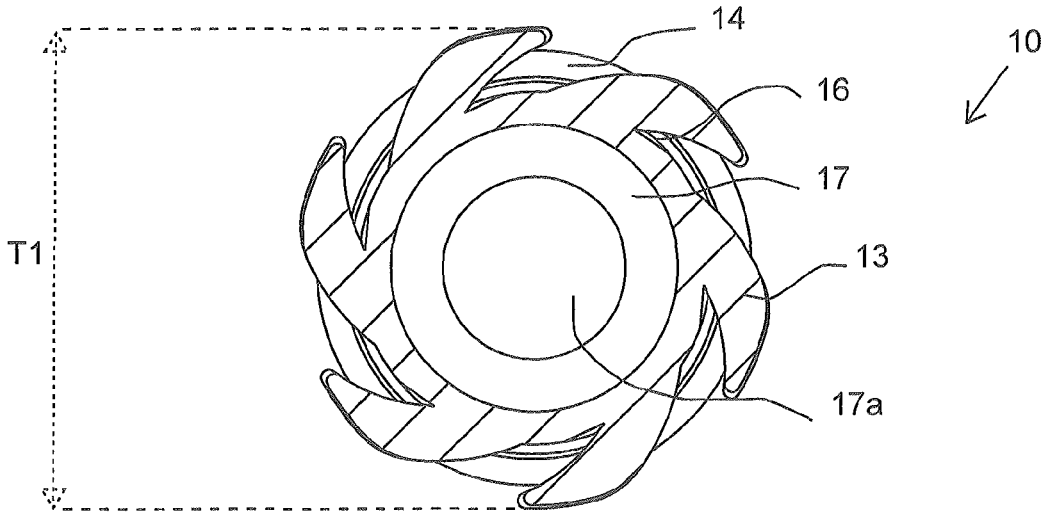
FIG. 4B is a cross-sectional view taken along line A-A of FIG. 4A.

Referring to FIG. 4A and FIG. 4B, the wiper 10 according to an another embodiment of the present invention comprises a plurality of regularly spaced grooves 16, extending parallel to longitudinal axis X. on the lower cylindrical section 11*b* of the tubular body 11. Each groove 16 adjoins the first joining side surface 13*a* (not visible in FIG. 4A because it is joined with tubular body 11—as represented by the dotted line in FIG. 4A) of a corresponding fin 13 such that a major length of the groove 16 is hidden by the corresponding inclined overlying fin 13. In other words, a major length of each of the plurality of grooves 16 underlies the respective fins 13. The grooves 16 facilitates easy bending of the fins 13 by permitting a portion of the fins 13 to be positioned in the grooves 16 when the fins 13 are bent against the tubular body 11 under influence of an external stress. In alternate embodiments of the present invention, the at least two grooves 16 may extend parallel to the joining side surface 13*a* of each of the fins 13. It is, however, obvious to a person skilled in the art that the wiper 10 of the present invention may be realized without grooves.

Figure 5A:
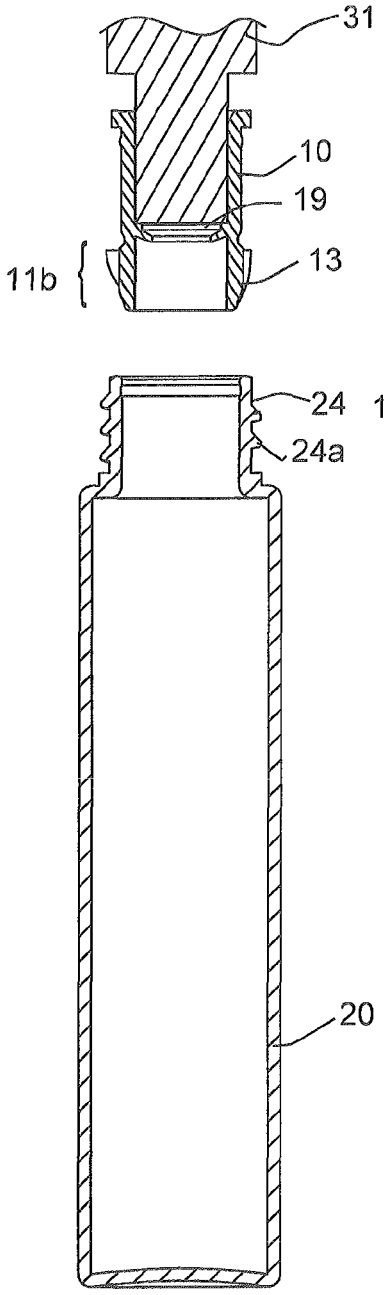
FIGS. 5A-5C illustrate various steps in mounting of a wiper of FIG. 2A according to an embodiment of the invention in a cosmetic container of FIG. 1.
Figure 5B:
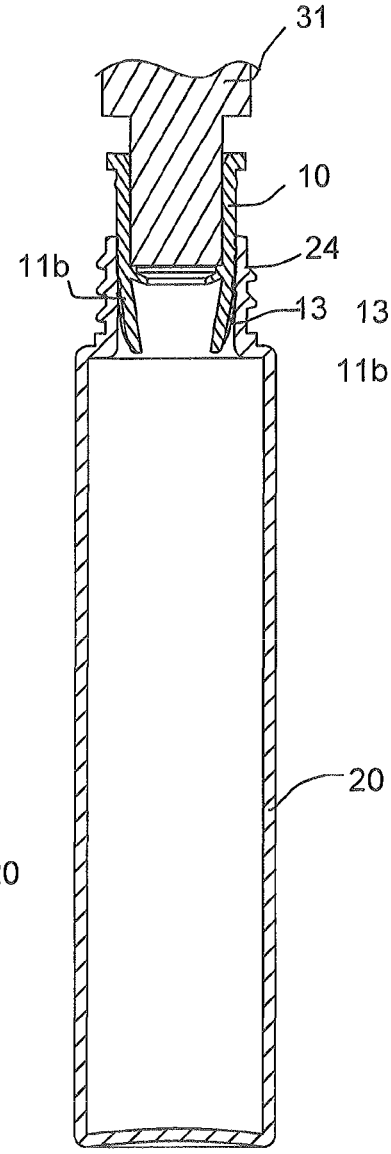
Figure 5C:
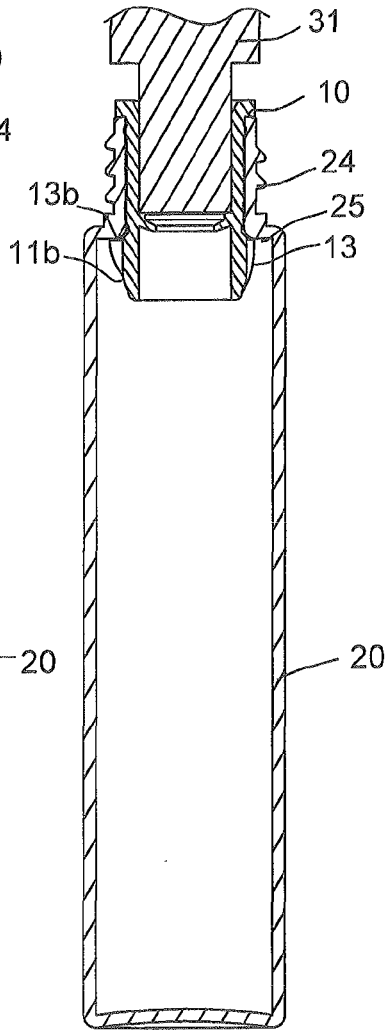

During mounting of the wiper 10 into the cosmetic container 20, the tubular body 11 is arranged inside the neck 24 of the cosmetic container 20 and the top annular flange 14 forms a stop retaining the wiper 10 in this position. FIGS. 5A-5C shows various steps in mounting of the wiper 10 according to an embodiment of the invention on to the cosmetic container 20. Commonly, an insertion shaft is employed to insert the elastically deformable wipers such as wipers made from elastomeric material, into neck of container. As seen in FIG. 5A, for inserting the wiper 10 of present invention into the neck 24, an insertion shaft 31 is made to rest on the annular seat 19 of the wiper 10. The insertion shaft 31 holds the wiper 10 by friction fitting. The insertion shaft 31 prevents the occurrence of back folding of the deformable wiper 10 during insertion into the cosmetic container 20. During this stage the wiper 10 is in first position in which the fins 13 are in their original non-collapsed position. The insertion shaft 31 is moved downward in counter-clockwise helical motion by rotating the insertion shaft 31 towards the bottom of the cosmetic container 20 to engage the wiper 10 further into the neck 24 of the cosmetic container 20. According to an alternate embodiment of invention, it is also possible to move the insertion shaft 31 axially downward without rotating, towards the bottom of the cosmetic container 20 to engage the wiper 10. The outer dimension T1 (shown in FIG. 4B) of the lower cylindrical section 11*b* of the tubular body 11 is greater than the internal diameter of the neck 24 of the cosmetic container 20, therefore when the wiper 10 is inserted into the neck 24, the wiper 10 experiences a radial external stress. As shown in FIG. 5B and FIG. 6B, the wiper 10 adopts a second position in which the fins 13 are collapsed horizontally against the exterior surface 15*b* of the tubular body 11 due to the radial external stress. This in turn causes the lower cylindrical section 11*b* of the tubular body 11 to deform radially inwardly to reduce the outer dimension T1 of the lower cylindrical section 11*b* of the tubular body 11. The deformation of lower cylindrical section 11*b* of the wiper 10 and collapsing of fins 13 makes it easy to insert the wiper into the neck 24. Referring to FIG. 5C, once the wiper 10 is fully inserted into the cosmetic container 20; the wiper 10 regains the first position wherein the fins 13 resiliently return to their original non-collapsed position. The upper surfaces 13*b* of the fins 13 are positioned below an inner shoulder 25 of the cosmetic container 20 and are in physical contact with the inner shoulder 25. According to an alternate embodiment of the invention (not shown in figures), the upper surfaces 13*b* may be positioned below an inner shoulder 25 but might not be in physical contact with the inner shoulder 25. The fins 13 do not collapse easily when the wiper 10 is tried to be pulled out as the second upper surface 13*b* of each fin 13 lock against the inner shoulder 25 of the cosmetic container 20 which increases resistance to extraction of the wiper 10 from the neck 24 of the cosmetic container 20. The wiper 10 can be extracted out from the cosmetic container 20 only when a high threshold force is reached, in such case the wiper 10 may distort. However, the wiper 10 do not ever experience this threshold force when the applicator 27 is withdrawn from the container 20 during normal use by the user as the pulling force required to withdraw the applicator 27 is too low than the required threshold force.

Figure 6A:
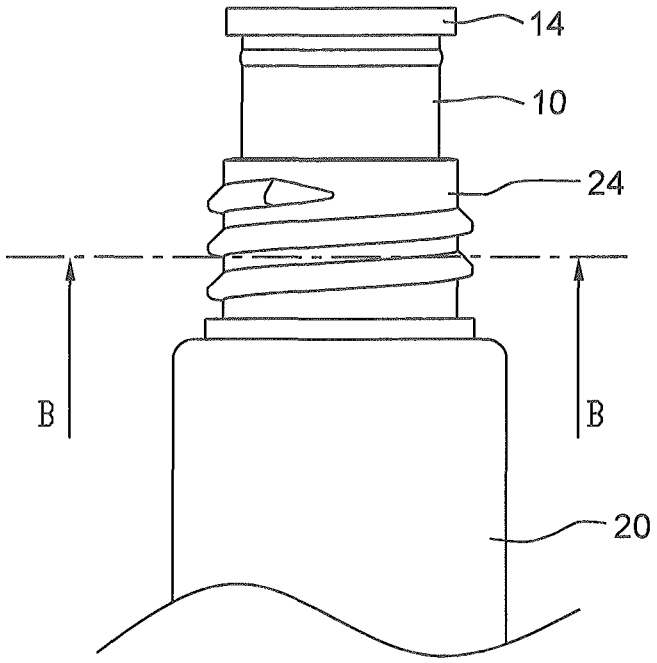
FIG. 6A is a enlarged portion of a front view of FIG. 5B without insertion shaft.
Figure 6B:
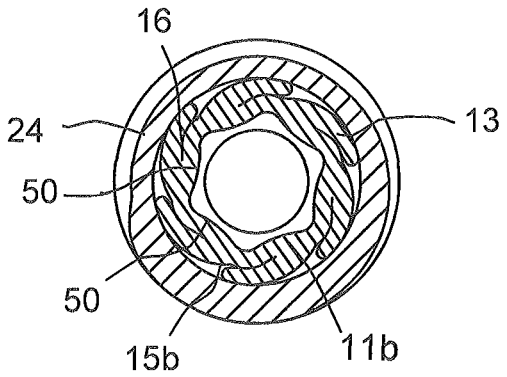
FIG. 6B is a cross-sectional view taken along line B-B of FIG. 6A.

FIG. 6A and FIG. 6B show further details of the wiper 10 when inserted into the neck 24, which was briefly explained above in reference to FIG. 5B. FIG. 6A corresponds to a partial front view of FIG. 5B without insertion shaft 31 and FIG. 6B shows a cross-sectional view taken along line B-B of FIG. 6A. As can be seen, when the wiper 10 is inserted into the neck 24 of the cosmetic container 20, the plurality of fins 13 on the lower cylindrical section 11*b* collapse horizontally against the exterior surface 15*b* of the tubular body 11 such that a portion of each fin 13 is disposed in respective groove 16 and the lower cylindrical section 11*b* of the tubular body 11 deforms radially inwardly to produce a plurality of wrinkles or undulations 50 thereon. Due to deformation of the lower cylindrical section 11*b* and collapsing of fins 13 outer dimension of the lower cylindrical section 11*b* is reduced and the wiper 10 fits easily into the neck 24 of the cosmetic container 20.

According to alternate embodiments of the present invention, the quadrant shape of the fins 13 may be replaced by other differing shapes such as a wedges, ear-like shape or triangular shape.

According to alternate embodiments of the present invention, wings can be used instead of fins 13 to implement the present invention.

In an alternate embodiment of the present invention, the plurality of regularly spaced fins extends radially outwardly from the exterior surface of the tubular body and is inclined in a clockwise direction.

According to an alternate embodiment of the present invention, the wiper 10 may be made of two different materials, wherein the upper section 11*a* may be made of a first material and the lower section 11*b* may be made of a second material softer than the first material.

While this invention has been particularly shown and described with reference to preferred embodiments thereof, it will be understood by those skilled in the art that various changes and modifications in form and details may be made thereto without departing from the spirit and scope of the invention as defined by the appended claims.

What is claimed is:

1. A wiper configured to be mounted on a cosmetic container, the wiper comprising:

a tubular body having an exterior surface and an interior surface;

the tubular body having an upper section and a lower section;

at least two collapsible members protruding from the exterior surface of the tubular body;

wherein each of the at least two collapsible members has a joining side surface;

wherein each of the at least two collapsible members is attached to the exterior surface of the tubular body through the joining side surface;

wherein the joining side surface is connected along its length to the exterior surface of the tubular body in a direction parallel to a longitudinal axis of the wiper;

wherein when the wiper is inserted into the cosmetic container, a free end of each of the at least two collapsible members moves in a circumferential direction to the tubular body and in a plane normal to the longitudinal axis of the wiper, from a non-collapsed position to a collapsed position; and wherein in the collapsed position the at least two collapsible members are closer to the tubular body than in the non-collapsed position.

2. A wiper according to claim 1, wherein the wiper is fabricated from an elastomeric material.

3. A wiper according to claim 1, wherein the at least two collapsible members extend radially outward from the exterior surface of the tubular body.

4. A wiper according to claim 1, wherein the at least two collapsible members are inclined in a counter-clockwise direction around the periphery of the tubular body.

5. A wiper according to claim 1, wherein the wiper further comprises an annular wiping lip configured to wipe an applicator when the applicator passes through the tubular body and wherein the annular wiping lip is located between two opposing ends of the tubular body and extends obliquely downwards from the interior surface of the tubular body.

6. A wiper, configured to be mounted on a cosmetic container, the wiper comprising:

a tubular body having an exterior surface and an interior surface;

the tubular body having an upper section and a lower section;

at least two collapsible members protruding from the exterior surface of the tubular body;

wherein each of the at least two collapsible members has a joining side surface which is elongated along a longitudinal axis of the wiper;

wherein each of the at least two collapsible members is attached to the exterior surface of the tubular body via its joining side surface;

wherein the joining side surface is connected along at least a length of the lower section of the tubular body;

wherein when the wiper is inserted into the cosmetic container, each of the at least two collapsible members flexes in a plane normal to the longitudinal axis of the wiper, from a non-collapsed position to a collapsed position;

wherein in the collapsed position the at least two collapsible members are closer to the tubular body than in the non-collapsed position; and wherein each of the at least two collapsible members further has an upper surface, a concave side surface and a convex side surface, and wherein the concave side surface faces the exterior surface of the tubular body and the convex site surface faces away from the exterior surface of the tubular body.

7. A wiper according to claim 6, wherein the concave side surfaces of the at least two collapsible members do not abut against the exterior surface of the tubular body in the non-collapsed position.

8. A wiper according to claim 7, wherein the concave side surfaces of the at least two collapsible members abut against the exterior surface of the tubular body in the collapsed position.

9. A wiper according to claim 1, wherein thickness of each of the at least two collapsible members decreases from the joining side surface towards the free end of the collapsible member.

10. A wiper according to claim 1, wherein the tubular body includes at least two grooves extending parallel to the longitudinal ads of the wiper, on the exterior surface of the lower section of the tubular body and wherein a major length of each of the at least two grooves underlies one of the at least two collapsible members of the tubular body.

11. A wiper according to claim 10, wherein portion of the at least two collapsible members dispose in the respective grooves on the exterior surface of the tubular body and the lower section of the tubular body deforms radially inwardly to produce a plurality of undulations when the wiper is inserted into a neck of the cosmetic container.

12. A wiper according to calm 11, wherein an outer dimension of the lower section of the tubular body is greater than an internal diameter of the neck of the cosmetic container and wherein deformation of the lower section and collapsing of the at least two collapsible members reduce the outer dimension of the lower section of the tubular body when the wiper is inserted into the neck of the cosmetic container.

13. A wiper according to claim 1, wherein the lower section and the upper section of the tubular body have same inner diameter and wherein an outer diameter of the lower section is less than that outer diameter of the upper section.

14. A wiper according to claim 6, wherein the upper surface of each of the at least two collapsible members includes a fillet to provide structural strength to the respective at least two collapsible members.

15. A wiper configured to be mounted on a cosmetic container, the wiper comprising:

a tubular body having an exterior surface and an interior surface;

the tubular body having an upper section and a lower section;

at least two collapsible members protruding from the exterior surface of the tubular body;

wherein each of the at least two collapsible members has a joining side surface;

wherein each of the at least two collapsible members is attached to the exterior surface of the tubular body through the joining side surface;

wherein a free end of each of the at least two collapsible members is capable of moving a circumferential direction to the tubular body and in a plane substantially normal to the longitudinal axis of the wiper, from a non-collapsed position to a collapsed position; and wherein in the collapsed position the at least two collapsible members are closer to the tubular body than in the non-collapsed position.

16. A wiper of claim 15, wherein after the wiper is inserted into the cosmetic container, the at least two collapsible members return back to their original non-collapsed position such that upper surfaces of the at least two collapsible members are positioned below an inner shoulder of the container.

17. A method of inserting the wiper of claim 15, into a cosmetic container, the method comprising:

inserting an insertion shaft into the tubular body of the wiper until the insertion shaft abut against an annular seat extending perpendicularly from an interior surface of the wiper;

moving the insertion shaft and the wiper downward into a neck of the cosmetic container in a helical motion for engaging the wiper into the neck of the cosmetic container; and removing the insertion shaft from the tubular body of the wiper after completion of engagement of the wiper with the neck of the cosmetic container.

* * * * *